US005720056A

United States Patent [19]

Aymes

[11] Patent Number: 5,720,056

[45] Date of Patent: Feb. 24, 1998

[54] ABOVE-GROUND SWIMMING POOL WITH SPILLWAY

[76] Inventor: Doniel G. Aymes, 999 Jersey Ave., New Brunswick, N.J. 08901

[21] Appl. No.: 748,347

[22] Filed: Nov. 14, 1996

[51] Int. Cl.[6] ..... E04H 4/04; E04H 4/14

[52] U.S. Cl. ..... 4/488; 4/489; 4/506; 4/507; 4/513; 52/169.7; 405/52; 405/79; D25/2

[58] Field of Search ..... 4/488, 489, 506, 4/507, 513, 505; 52/169.7; 405/52, 79, 80, 84, 87, 88, 89, 90, 91; D23/201; D25/2

[56] References Cited

U.S. PATENT DOCUMENTS

| | | | |
|---|---|---|---|
| 2,928,251 | 3/1960 | Waring | 405/90 |
| 3,837,016 | 9/1974 | Schindler et al. | 4/489 |
| 3,952,338 | 4/1976 | Troxclair | 4/489 |
| 4,001,899 | 1/1977 | Mathis | 4/489 |
| 4,238,859 | 12/1980 | Badon, Jr. | D25/2 |
| 5,083,327 | 1/1992 | Gillebaard | 4/506 |
| 5,167,368 | 12/1992 | Nash | D23/201 |
| 5,170,517 | 12/1992 | Stegmeier | 4/506 |
| 5,415,221 | 5/1995 | Zakryk | 4/489 |

FOREIGN PATENT DOCUMENTS

| | | | |
|---|---|---|---|
| 2200840 | 8/1988 | United Kingdom | 52/169.7 |

*Primary Examiner*—Charles R. Eloshway

*Attorney, Agent, or Firm*—McAulay Fisher Nissen Goldberg & Kiel, LLP

[57] ABSTRACT

An above-ground swimming pool comprises a primary wall extending above a ground surface to enclose a primary pool area. The primary wall including an enclosure region having a first wall height and a spillway region having a second wall height lower than the first wall height. An arcuate secondary wall extends above the ground surface. Opposite ends of the secondary wall are attached to the primary wall at either side of the spillway region. The secondary wall has a third wall height lower than the first and second wall heights. The secondary wall and the primary wall enclose a secondary pool area. A pump is provided to pumping water from the secondary pool to the primary pool to generate a flow of water over the spillway region. The primary wall may consist of a first wall and a second wall joined together at a transition piece. The secondary wall may additionally be connected to the primary wall at the transition piece.

27 Claims, 5 Drawing Sheets

ABOVE-GROUND SWIMMING POOL WITH SPILLWAY

BACKGROUND OF THE INVENTION

This invention relates to an above-ground swimming pool. In particular, the invention relates to an above-ground pool having two pool levels.

Above-ground swimming pools have long been popular for their relative low cost, ease of installation, and ease of removal relative to in-ground pools. While the recreational value of above-ground swimming pools is widely recognized, the full potential of the functional and aesthetic benefits of such pools has yet to be realized. Because the commonplace circular and oval designs of above-ground pools have been so successful at providing backyard entertainment at a reasonable cost, little effort has gone into making substantial modifications of the basic above-ground pool.

OBJECTS OF THE INVENTION

A general object of the present invention is to provide an above-ground swimming pool with a heightened aesthetic appeal and enhanced function.

It is another object of the invention to provide an above-ground swimming pool having two pool levels.

A further object of the invention is to provide an above-ground swimming pool with a spillway.

An additional object of the invention is to provide an above-ground swimming pool with an illuminated edge effect.

These and other objects of the present invention will be apparent from the drawings and detailed descriptions herein.

SUMMARY OF THE INVENTION

An above-ground swimming pool according to the present invention comprises a first wall which extends substantially vertically above a first ground surface and which has a first wall height. The first wall has two opposite ends. A pair of transition elements are provided. Each transition element is mounted to a respective end of the first wall. A second wall extends substantially vertically above the first ground surface. The second wall has a second wall height smaller than the first wall height. The second wall has opposite ends each attached to a respective one of the transition elements. The first wall and the second wall together defining a primary pool area. A third wall extends substantially vertically above a second ground surface adjacent the first ground surface. The third wall has a third wall height smaller than the first and second wall heights. The third wall has opposite ends each attached to a respective one of the transition elements. The second wall and the third wall together define a secondary pool area.

A water inlet is disposed in the secondary pool, and a water outlet is disposed in the primary pool. A pipeline extends between the water inlet and the water outlet, and a pump is provided along the pipeline for pumping water from the secondary pool to the primary pool, to recirculate water flowing from the primary pool over the second wall into the secondary pool. A check valve is disposed along the pipeline for preventing water from flowing in a reverse direction from the outlet to the inlet.

An additional water outlet may be disposed in the secondary pool. The additional water outlet communicates with the pipeline through a T-valve, so that water pumped through the pump can selectively be directed through the water outlet in the primary pool or through the additional water outlet in the secondary pool.

A weir having a substantially triangular shape can be mounted to the first and second walls in a comer formed by an end edge of the first wall and an upper edge of the second wall.

A primary liner is disposed in the first pool area. The primary liner extends generally horizontally over the first ground surface and generally vertically along the first and second walls. A secondary liner is disposed in the second pool area. The secondary liner extends generally horizontally over the second ground surface and generally vertically along the second and third walls.

The primary liner and the secondary liner may be attached to one another to form an integral liner, so that the integral liner extends over the upper edge of the second wall. Alternatively a receptor band extends over the upper edge of the second wall. The receptor band includes a first receptor for receiving a portion of the primary liner and a second receptor for receiving a portion of the secondary liner. The receptor band further includes a recess for receiving the upper edge of the second wall. Where the primary liner includes a beaded edge, the first receptor is a cusp extending along the receptor band for receiving the primary beaded edge. Likewise, where the secondary liner includes a beaded edge, the second receptor is a cusp extending along the receptor band for receiving the beaded edge of the secondary liner. A liner flap extends over the upper edge of the second wall. The liner flap may be attached to or integral with the primary liner.

A tension cord, such as a stranded wire cable, may be attached to each of the transition elements. The tension cord extends across the second wall below the upper edge of the second wall and abuts against a cusp of the receptor band. A tension buckle is mounted along the tension cord.

A fiber optic or low-voltage illumination element may be mounted along the upper edge of the second wall.

According to another conceptualization of the present invention, an above-ground swimming pool comprises a primary wall which extends substantially vertically above a first ground surface and encloses a primary pool area. The primary wall includes an enclosure region with a first wall height and a spillway region with a second wall height. The second wall height of the spillway region is lower than the first wall height of the enclosure region. A secondary wall extends substantially vertically above a second ground surface adjacent to the first ground surface. Opposite ends of the secondary wall are attached to the primary wall at opposite sides of the spillway region. The secondary wall has a third wall height lower than the first and second wall heights. The secondary wall and the primary wall enclose a secondary pool area. A water inlet is mounted in the secondary pool, and a water outlet is mounted in the primary pool. A pipeline extends between the water inlet and the water outlet, and a pump is disposed along the pipeline to pumping water from the secondary pool area to the primary pool area. A filter can be mounted along the pipeline to filter water pumped by the pump.

An additional water outlet may be disposed in the secondary pool. The additional water outlet communicates with the pipeline through a T-valve, so that water pumped through the pump can selectively be directed through the water outlet in the primary pool area or through the additional water outlet in the secondary pool area.

The second ground surface may be level with the first ground surface. Alternatively, the second ground surface may be at a level lower than a level of the first ground surface. In the latter case, the third wall may extend from the second ground surface to a height above the level of the first ground surface, or the third wall may extend from the second ground surface to approximately the level of the first ground surface. The second ground surface may slope from a level approximately at the level of the first ground surface to a level below the level of the first ground surface.

The primary wall may be comprised of a first wall section including the enclosure region and a second wall section including the spillway region. The first wall section is attached to the second wall section. The attachment of the second wall section and the first wall section may be made by means of a transition element attached to both the first and the second wall segments. The attachment of the secondary wall to the primary wall may be made by attachment of the secondary wall to the transition element.

The second wall section may include a transition region adjacent to the spillway region. The transition region has a height graded from the first wall height to the second wall height. Alternatively or additionally, the first wall section includes a transition region adjacent to the spillway region, the transition region having a height graded from the first wall height to the second wall height.

A primary liner is disposed in the primary pool area. The primary liner extends generally horizontally over the first ground surface and generally vertically along the primary wall at the enclosure region and the spillway region. A secondary liner is disposed in the second pool area. The secondary liner extends generally horizontally over the second ground surface and generally vertically along the primary wall at the spillway region and the secondary wall.

The secondary wall may be supported above the surface of the ground with a plurality of spacers disposed along the secondary wall.

According to a further conceptualization of the present invention, an above-ground swimming pool comprises a primary wall extending above a first ground surface enclosing a primary pool area. The primary wall includes an enclosure region having a first wall height and a spillway region having a second wall height lower than the first wall height. An enclosure defines a secondary pool area. The secondary pool area is adjacent to the primary pool area and extends at least along the spillway region of the primary wall. The primary wall has an upper edge along the spillway region. A primary liner is disposed in the primary pool area. The primary liner extends generally horizontally over the first ground surface and generally vertically along the primary wall at the enclosure region and the spillway region. The primary liner has a first bead attached thereon extending approximately across the upper edge of the spillway region.

A secondary liner is disposed in the secondary pool area. The secondary liner extends generally vertically along the primary wall at the spillway region. The secondary liner has a second bead attached thereon extending approximately across the upper edge of the spillway region. A receptor band has a substantially inverted-U-shaped cross-section for receiving the upper edge of the spillway region. The receptor band is disposed on the upper edge. The band further includes a first cusp mounted thereon for receiving the first bead and a second cusp mounted thereon for receiving the second bead.

The primary liner may further include a liner flap mounted thereon, with the flap extending over said upper edge of said spillway region.

A third cusp may be mounted along the receptor band. A liner flap is provided having a bead therealong, and the bead is mounted in the third cusp, with the liner flap extending over the upper edge of said spillway.

According to yet another conceptualization of the present invention, an above-ground pool comprises a wall defining an enclosed pool area. The wall includes a first portion with a first height and a second portion with a second height lower than the first height. The second height defines a spillway over the wall. Componentry is provided to recharge the pool area with water at a rate substantially equal to a rate that water flows over the spillway.

The pool may further include a pair of weirs disposed on the wall at opposite ends of the second portion. Alternatively, the wall may further include pair of transition portions each located between the first portion and the second portion. The transition portions have a height which varies between the first height and the second height.

The pool may further include a structure for defining an additional pool area which receives water from the spillway. In that case, the componentry for recharging the pool with water includes componentry for circulating water from the additional pool area to the pool area defined by the wall.

A tension cable may be fastened at opposite ends of the first portion of the pool wall. The tension cable extends along an outer side of the second portion. The second portion of the wall is provided with an abutment on the outer side, said cable engaging said abutment to prevent said cable from slipping upwardly along said outer side.

An above-ground swimming pool according to the invention takes advantage of the low cost of above-ground pool assembly, while providing the additional recreational benefits of a secondary wading or splashing pool as well as the aesthetic benefits of a spillway effect.

DETAILED DESCRIPTION OF THE INVENTION

Figure 1:
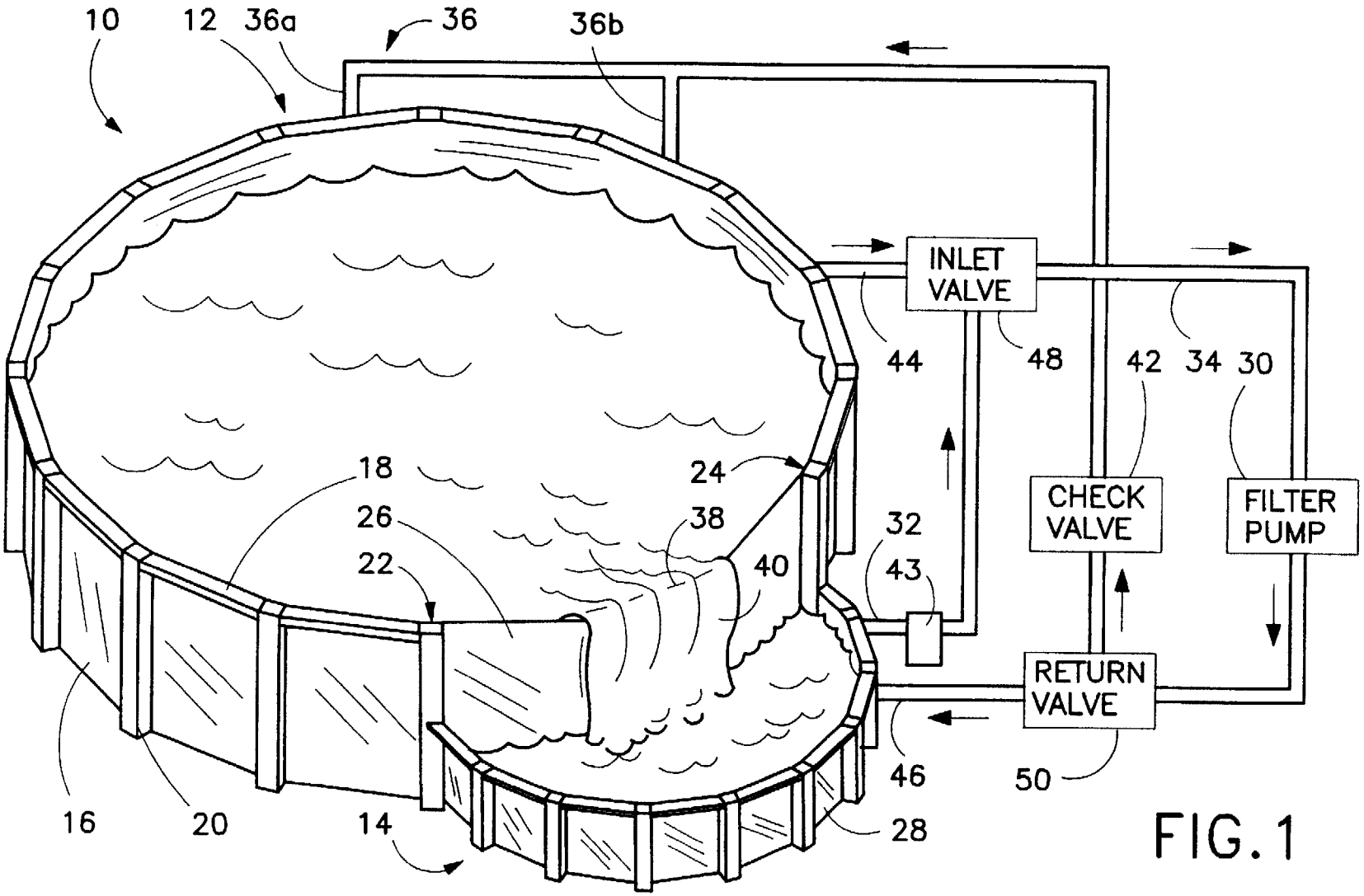
FIG. 1 is partially a perspective view and partially a block diagram of a swimming pool in accordance with the present invention.

As illustrated in FIG. 1, an above-ground swimming pool assembly 10 includes a primary pool 12 and a secondary pool 14. A first wall 16 extends substantially vertically above the ground surface and encloses a majority of primary pool 12. First wall 16 preferably has a wall height of approximately 52 inches above the ground, and primary pool 12 is preferably has a circular shape with a diameter of between eight and 34 feet, or an oval shape with dimensions (in feet) of between 10×12 and 18×39. These dimensions are preferred as being commonly available sizes for standard above-ground pools, but it will be clear that primary pools having various other dimensions can also be constructed. First wall 16 is supported around its perimeter with a plurality of horizontal rail supports 18 and vertical supports 20 in a manner conventional in above-ground pools. At joints 22 and 24, opposite ends of first wall 16 are attached to opposite ends of a second wall 26. Second wall 26 extends substantially vertically above the surface of the ground. The second wall has a wall height which is smaller than the height of the first wall, and is preferably between 1 inch and 10 inches lower than the first wall height. One preferred height of the second wall is 48 inches above the ground where the first wall stands 52 inches above the ground. The first wall and the second wall are joined together form a single primary wall which defines the perimeter of primary pool area 12. A third substantially vertical pool wall 28 has a wall height smaller than both the first and the second wall heights. A preferred height the third wall 28 is 24 inches above the ground. Third wall 28 has opposite ends attached to first wall 16 and second wall 26 at joints 22 and 24. Walls 26 and 28 together form the perimeter of secondary pool 14. Secondary pool 14, with a water depth of generally less than about two feet, can be used as a wading pool or splasher pool for children lacking sufficient swimming skills to play in primary pool 12, which generally has a depth of about four feet.

A water pump 30, which may include a water filter to clean the water pumped therethrough, draws water from secondary pool 14 through a water inlet 32. Water inlet 32 may be a "skimmer" or other water inlet commonly available for swimming pool use. Water from inlet 32 is drawn through pipeline 34 and pumped through a water return outlet line 36 through one or more water returns **36*a*, 36*b* into primary pool 12. The water level in primary pool 12 is kept at a level at or near the level of upper edge 38 of second wall 26. Thus, as water is pumped into primary pool 12 through outlet line 36, water flows over upper edge 38 to form a spillway 40 into secondary pool 14. First wall 16 stands above the water level in the primary pool, thus defining an enclosure region of the primary pool wall over which water does not flow. Second wall 26, standing at or near the water level of the primary pool and allowing water to flow over upper edge 38, defines a spillway region of the primary pool wall. Preferably, water is pumped into primary pool 12 and over upper edge 38** at a rate of between 40 and 120 gallons per minute.

Because the water level in primary pool 12 is higher than the water level in secondary pool 14, pump 30 pumps against a water pressure gradient. In case pump 30 is shut down for maintenance, or if pump 30 should fail, water would tend to flow backward through pipeline 34 from primary pool 12 to secondary pool 14, which could cause secondary pool 14 to overflow. Accordingly, a check valve 42 is provided along pipeline 34 to prevent backward flow of water from pool 12 to pool 14 while permitting water flow in the forward direction from pool 14 to pool 12. An additional check valve 43 may be provided at water outlet 32 to further prevent water from flowing from primary pool 12 to secondary pool 14 through inlet 32.

Thus, the primary circulation of water in above-ground pool 10 is from primary pool 12, over spillway 40 to secondary pool 14, into inlet 32, through pipeline 34 and pump 30, and back into primary pool 12 through check valve 42 and return outlet 36. Additional inlets and outlets may be included for the circulation of water in the pool 10. For example, an additional water inlet 44 may be disposed in primary pool 12, and an additional water outlet 46 may be provided in pool 14. Inlet valve 48 is provided along pipeline 34 to select between multiple water inlets 32 and 44, and return valve 50 is provided along pipeline 34 to select between multiple water outlets 36 and 46. Valves 48 and 50 are typically T-valves which allow selection between one of two branches of flow.

Inlet valve 48 and return valve 50 can be operated to allow water flow only in the primary circulation path as described above. However, alternative flow paths may be selected. For example, if inlet valve 48 is operated to select inlet 44 and return valve 50 is operated to select return outlet 36, then water is circulated only in primary pool 12, and no water flows over spillway 40. Similarly, if inlet valve 48 is operated to select inlet 32 and return valve 50 is operated to select return outlet 46, then water is circulated only in secondary pool 14, and again no flow occurs over spillway 40. In either of these cases, pump 30 does not work against a water pressure gradient, resulting in more efficient water circulation and filtration with the sacrifice of the aesthetic benefits of spillway 40.

There are a variety &options for attaching first wall 16, second wall 26, and third wall 28 to one another to form above-ground pool 10. The walls may be attached directly to one another, the walls may be attached indirectly by one or more transition pieces, or two or more of the walls may be integral with one another, being formed of a single piece of material or being welded or otherwise permanently bonded to one another.

Figure 2:
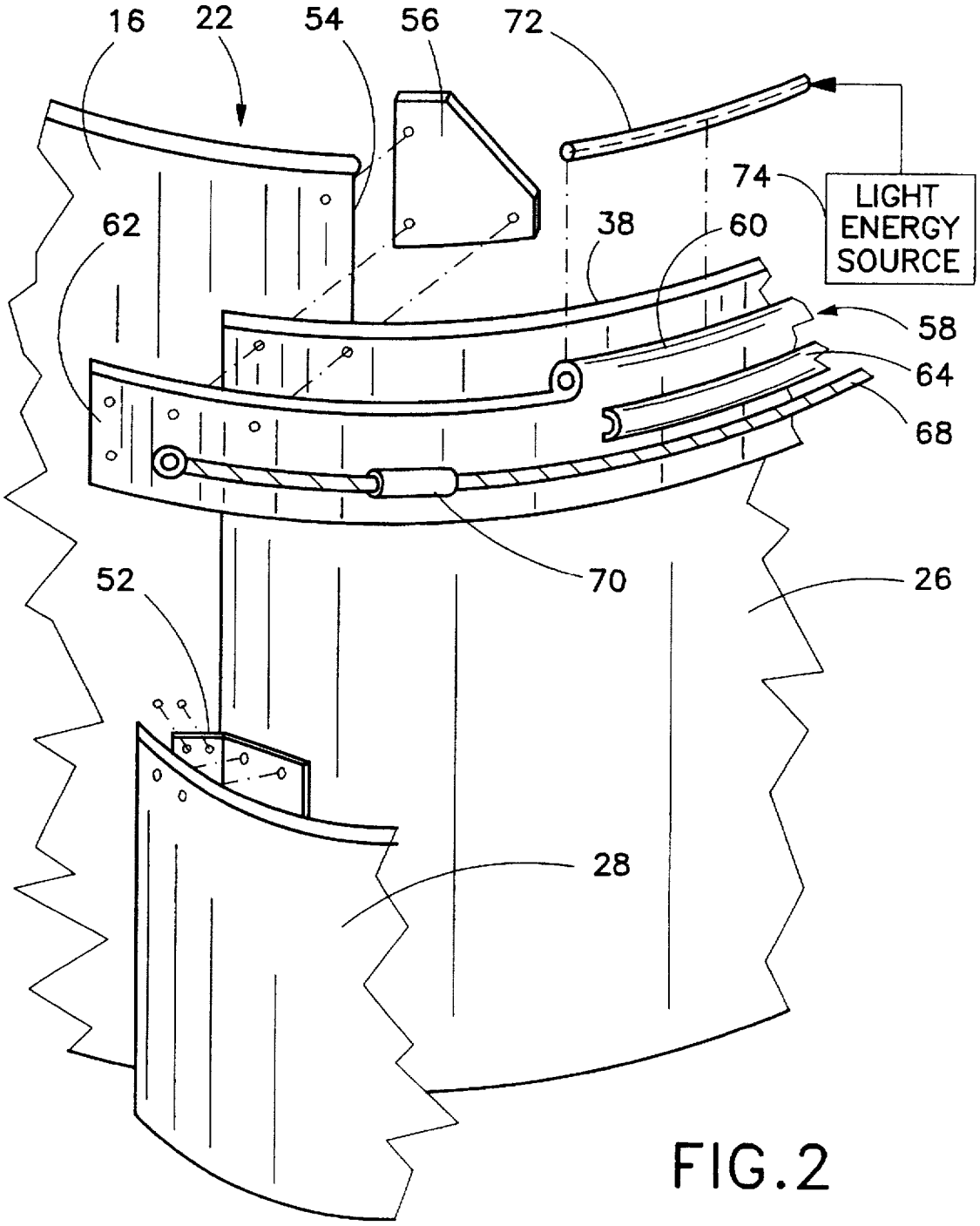
FIG. 2 is an exploded view of a portion of a swimming pool in accordance with the present invention.

One system &attaching first wall 16, second wall 26, and third wall 28 at joint 22 of first wall 16 is illustrated in FIG. 2. An angled transition piece 52 is provided for attaching third wall 28 to first and second walls 16 and 26. First wall 16 has a vertical edge 54 which meets top edge 38 of second wall 26 at an angle. A weir 56 having a substantially triangular shape is mounted to walls 16 and 26 in the angle to brace edges 54 and 38 and to smooth the transition between the enclosure portion and the spillway portion of primary wall 16.

In exemplary, nonexhaustive variations of the assembly illustrated in FIG. 2, transition piece 52 may be an angled extension of secondary wall 26. Transition piece 52 may extend upwardly and terminate in an angular or curved shape to replace or supplement weir 56. Weir 56 may also be replaced or supplemented by an angular or curved extension on walls 16 and/or 26. Transition piece 52 may be constructed of stainless steel, hot dipped galvanized steel, aluminum extrusions, polymer resins, or other material having a high strength and good resistance to corrosion.

A receptor band 58 has a U-shaped fold 60 which receives upper edge 38 of wall 26. Band 58 includes a hoop extension 62 which attaches to joint 22 to aid in structurally supporting upper edge 38. The opposite end of receptor band 58 is additionally provided with a hoop extension (not illustrated) which is attached to joint 24. Band 58 further includes an outer cusp 64 and an inner cusp 66 for attachment to pool liners, as will be discussed in further detail below with reference to FIG. 6. A tension cord 68, preferably made of stranded wire cable, is attached at joints 22 and 24 and extends across second wall 26 in parallel relation to edge 38. Tension cord 68 provides structural support for second wall 26 and upper edge 38 by seating under outer cusp 64 of receptor band 58 (see FIG. 6). Tension on tension cord 68 can be adjusted with the use of a turnbuckle 70 mounted along cord 68.

As further illustrated in FIG. 2, an elongate illumination source 72 may be attached along upper edge 38. Illumination source 72 is operatively connected to a light energy source 74. Illumination source 72 may be an elongate fiber optic illuminator, in which case energy source 74 supplies light to illumination source 72 along optical fibers. Alternatively, illumination source 72 may be a low voltage, watertight electrical illuminator, in which case energy source 74 is a source of low voltage power. Fiber optic illumination, however, is preferred for reasons of safety and reliability. The elongate illumination source provides an aesthetic illuminated spillway edge effect as well as providing an indicator of the location of edge 38.

Figure 3:
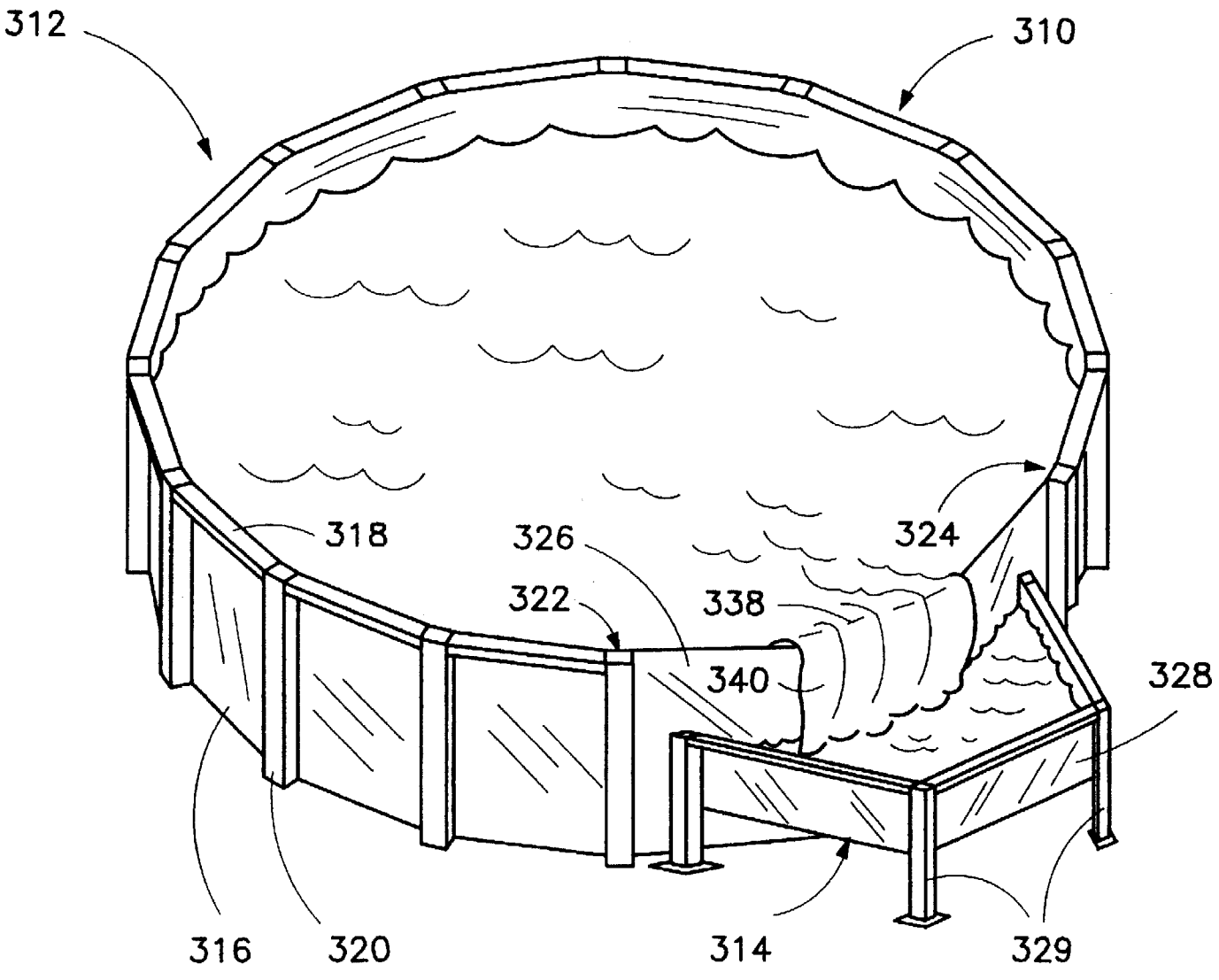
FIG. 3 is a perspective view of another swimming pool in accordance with the present invention.

As illustrated in FIG. 3, another above-ground swimming pool assembly 310 includes a above the ground surface and encloses a majority of primary pool 12. First wall 3 16 preferably has a wall height of approximately 52 inches above the ground, and primary pool 312 preferably has a circular shape with a diameter of between eight and 34 feet, or an oval shape with dimensions (in feet) of between 10×12 and 18×39. First wall 316 is supported around its perimeter with a plurality of horizontal rail supports 318 and vertical supports 320 in a manner conventional among above-ground pools. First wall 316 has two opposite ends, at joints 322 and 324, which are attached to opposite ends of a second wall 326. Second wall 326 extends substantially vertically above the surface of the ground. The second wall has a wall height which is smaller than the height of the first wall, and is preferably between 1 inch and 10 inches lower than the first wall height. One preferred height of the second wall is 48 inches above the ground where the first wall stands 52 inches above the ground. The first wall and the second wall joined together form a single primary wall which defines the perimeter of primary pool area 312. A third wall 328 extends substantially vertically above the ground. Third wall 328 has a wall height smaller than both the first and the second wall heights. Third wall 328 is held above the surface of the ground with a plurality of spacers 329. Opposite ends of third wall 328 are attached to the primary wall made up of first wall 316 and second wall 326.

A water pump system (not illustrated) analogous to that of swimming pool assembly 10 pumps water from secondary pool 314 to primary pool 312. The water level in primary pool 312 is kept at a level at or near the level of upper edge 338 of second wall 326. Thus, as water is pumped into primary pool 312, water falls over upper edge 338 to form a spillway 340 flowing into secondary pool 3 14. First wall 316 stands above the water level in the primary pool, thus defining an enclosure region of the primary pool wall over which water does not flow. Second wall 326, standing at or near the water level of the primary pool and allowing water to flow over upper edge 338, defines a spillway region of the primary pool wall.

Figure 6:
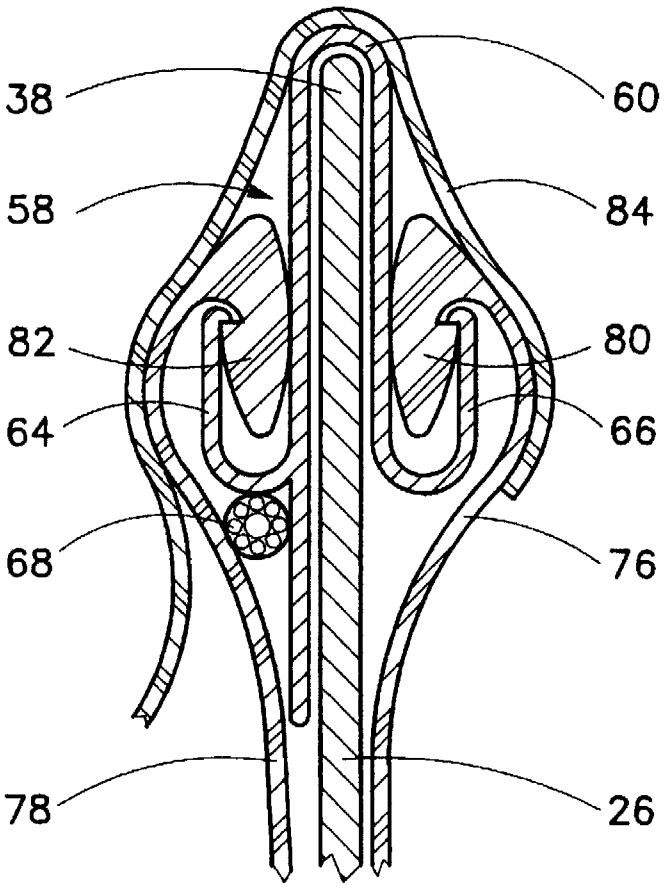
FIG. 6 is a cross-sectional view of a spillway liner attachment in accordance with the present invention.
Figure 4:
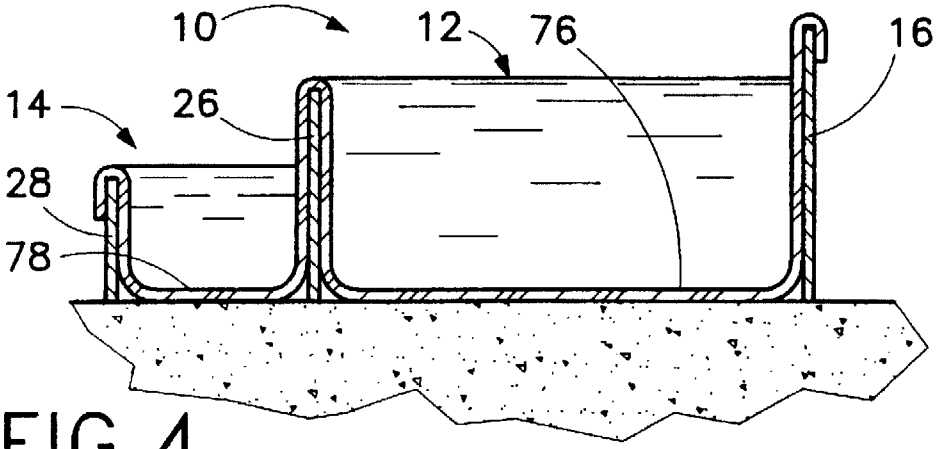
FIG. 4 is a schematic cross-sectional view of the swimming pool of FIG. 1.
Figure 9:
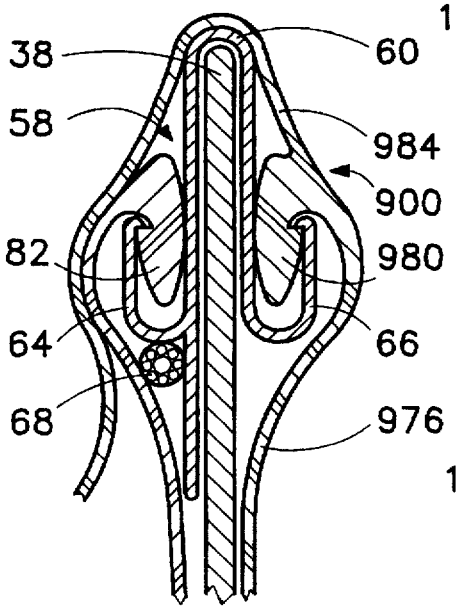
FIG. 9 is a cross-sectional view of an alternative spillway liner attachment.

In order to prevent water from leaking out of swimming pool 10 or 310, a liner, typically of a vinyl material, is employed to line the insides of the above-ground pools. As illustrated in FIG. 4, primary pool 12 is lined with a primary liner 76 and secondary pool 14 is lined with secondary liner 78. Liner 78 may be attached to third wall 28, and liner 76 may be attached to first wall 16, by an overlap or by a beaded receptor 58, as is known in above-ground pool design. As shown in FIG. 6, liners 76 and 78 are attached at upper edge 38 of second wall 26 by means of receptor band 58. Inner cusp 66 of band 58 receives a bead 80 of liner 76. Outer cusp 64 receives a bead 82 of liner 78. To help prevent water leakage, a liner flap 84 is sealed to liner 76 and extends over upper edge 38 of wall 26. Liner flap 84 may be welded or adhered to liner 76, or liner flap 84 may be a continuous extension of liner 76, as illustrated in FIG. 9. In FIG. 9, a unitary liner 900 includes primary liner portion 976 and a liner flap portion 984 formed from a single piece of material such as vinyl. A bead 980 is mounted along unitary liner 900 and is received in cusp 66 of receptor 58.

Figure 11:
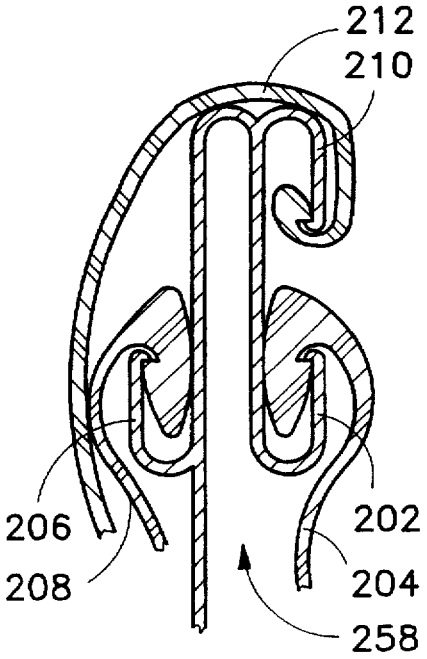
FIG. 11 is a cross-sectional view of yet another alternative spillway liner attachment.

Alternatively, as illustrated in FIG. 11, a receptor band 258 may be provided with three cusps to accommodate a separate beaded flap 212. An inner cusp 202 receives a primary liner 204. An outer cusp 206 receives a secondary liner 208, and a flap cusp 210 receives flap 212.

Figure 10:
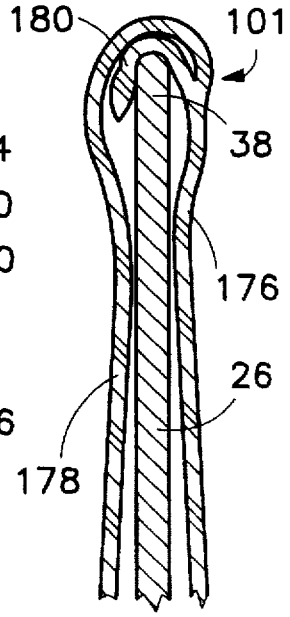
FIG. 10 is a cross-sectional view of an additional alternative spillway liner attachment.

In an embodiment illustrated in FIG. 10, primary and secondary liners are joined together as a single continuous liner 101 including a primary liner portion 176 for lining primary pool 12 and a secondary liner portion 178 for lining secondary pool 14. Continuous liner 101 is draped over second wall 26, and a liner flap is not necessary to prevent leakage. An elongate cusp 180 may be mounted along liner 101 to grasp upper edge 38 of second wall 26 to aid in keeping liner 101 in place.

Figure 5:
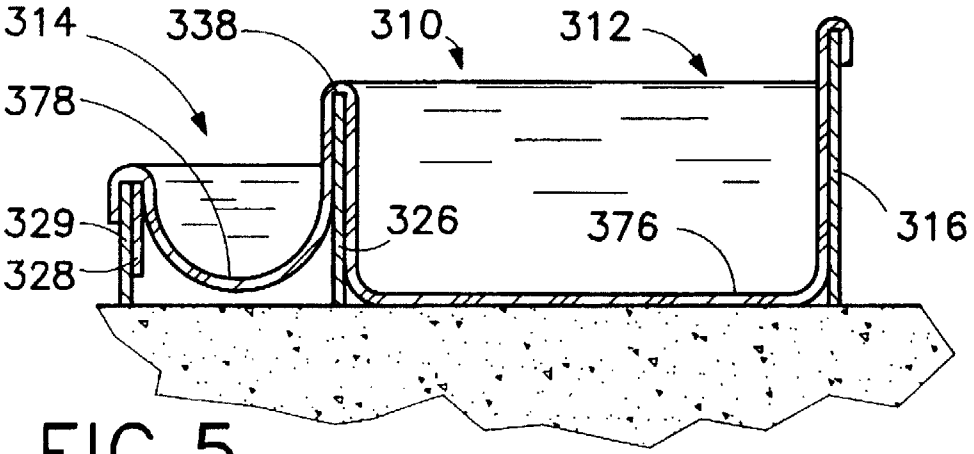
FIG. 5 is a schematic cross-sectional view of the swimming pool of FIG. 3.

In FIG. 5, primary pool 312 is lined with a first liner 376 and secondary pool 314 is lined with secondary liner 378. Liner 378 may be attached to third wall 328, and liner 376 may be attached to first wall 3 16, by an overlap or by a beaded receptor, as is known in above-ground pool design. Liners 376 and 378 are attached at upper edge 338 of second wall 26 as a single contiguous liner or by means of receptor band 58 as described above with respect to FIG. 6. In pool 310, third wall 328 is supported off the ground with spacers 329, and liner 378, preferably constructed of a heavy-duty vinyl material, hangs above the surface of the ground. An additional structure (not illustrated) may be provided to support the bottom of liner 378.

Figure 7:
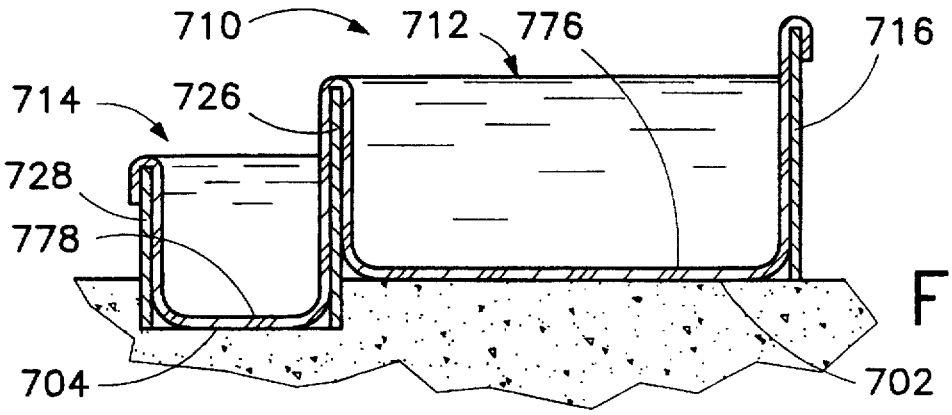
FIG. 7 is a schematic cross-sectional view of another swimming pool with a spillway.

As illustrated in FIG. 7, an above-ground swimming pool 710 includes a primary pool area 712 and a secondary pool area 714. Primary pool area 712 is enclosed with a primary wall including enclosure region 716 and spillway region 726 and is lined with a primary liner 776. Primary pool area 702 rests on a first ground level 702. Secondary pool area 714 is enclosed with a secondary wall 728 and with the primary wall at spillway region 726 and is lined with secondary liner 778. Secondary pool area 714 rests on a second ground level 704, lower than first ground level 702. As with above-ground pools 10 and 310, water is pumped from secondary pool 714 to primary pool 712, causing water to flow over spillway region 726 of the primary wall.

Figure 8:
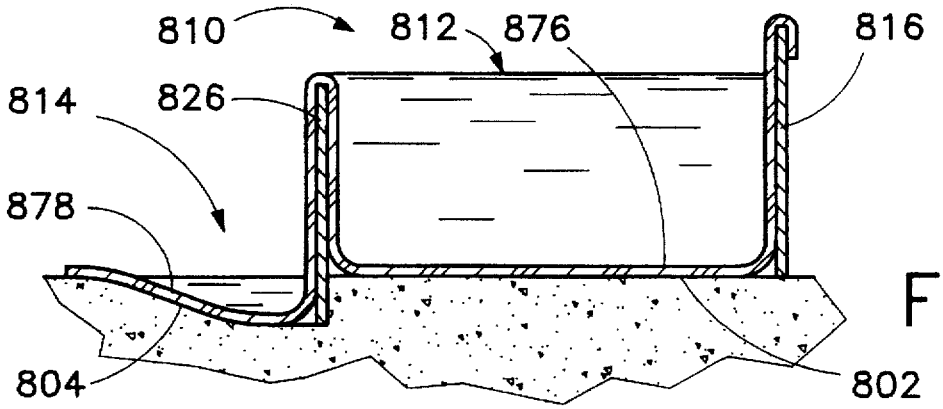
FIG. 8 is a schematic cross-sectional view of an additional swimming pool with a spillway.

As illustrated in FIG. 8, an above-ground swimming pool 810 includes a primary pool area 812 and a secondary pool area 814. Primary pool area 812 is enclosed with a primary wall including enclosure region 816 and spillway region 826 and is lined with a primary liner 876. Primary pool area 812 rests on a first ground level 802. A ground surface 804 slopes downward from the level of ground surface 802 to form a beach entry to secondary pool area 814. Secondary pool 814 is lined with secondary liner 878.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An above-ground swimming pool comprising:

a primary wall extending above a first ground surface enclosing a primary pool area, said primary wall including an enclosure region having a first wall height and a spillway region having a second wall height lower than said first wall height;

a secondary wall extending above a second ground surface adjacent to said first ground surface, opposite ends of said secondary wall being attached to said primary wall at opposite sides of said spillway region, said secondary wall having a third wall height lower than said first and second wall heights, said secondary wall and said primary wall enclosing a secondary pool area, said primary pool area being larger than said secondary pool area; and means for pumping water from said secondary pool area to said primary pool area.

2. The above-ground swimming pool defined in claim 1 wherein said means for pumping includes:

a water inlet mounted in said secondary pool area;

a water outlet mounted in said primary pool area;

a pipeline extending between said water inlet and said water outlet; and a pump along said pipeline for pumping water from said secondary pool area to said primary pool area.

3. The above-ground swimming pool defined in claim 2 wherein said primary wall includes a first wall section including said enclosure region and a second wall section including said spillway region, said first wall section being attached to said second wall section.

4. The above-ground swimming pool defined in claim 3 wherein said second wall section includes a transition region adjacent to said spillway region, said transition region having a height graded from said first wall height to said second wall height.

5. The above-ground swimming pool defined in claim 2 wherein said secondary wall is supported above a ground surface with a plurality of spacers disposed along said secondary wall.

6. The above-ground swimming pool defined in claim 2, further comprising a primary liner disposed in said primary pool area, said primary liner extending generally horizontally over the first ground surface and generally vertically along said primary wall at said enclosure region and said spillway region, and a secondary liner disposed in said secondary pool area, said secondary liner extending generally horizontally over the second ground surface and generally vertically along said primary wall at said spillway region and secondary walls.

7. The above-ground swimming pool defined in claim 6 wherein said primary liner and said secondary liner are attached to one another to form an integral liner, said integral liner extending over an upper edge of said primary wall at said spillway region.

8. The above-ground swimming pool defined in claim 7, further comprising a receptor band extending over an upper edge of said primary wall at said spillway region, said receptor band including a first receptor for receiving a portion of said primary liner and a second receptor for receiving a portion of said secondary liner.

9. The above-ground swimming pool defined in claim 8 wherein said primary liner includes a primary beaded edge, said first receptor being a primary cusp extending along said receptor band for receiving said primary beaded edge, and said secondary liner includes a second beaded edge, said second receptor being a cusp extending along said receptor band for receiving said secondary beaded edge.

10. The above-ground swimming pool defined in claim 9, further comprising a tension cord attached to said primary wall at either side of said spillway region, said tension cord extending across said secondary wall below said upper edge of said secondary wall, said tension cord abutting against said second receptor.

11. The above-ground swimming pool defined in claim 2 wherein the second ground surface is at a level lower than a level of the first ground surface.

12. The above-ground swimming pool defined in claim 11 wherein said third wall extends from the second ground surface to a height above the level of the first ground surface.

13. The above-ground swimming pool defined in claim 11 wherein said third wall extends from the second ground surface to approximately the level of the first ground surface.

14. The above-ground swimming pool defined in claim 13 wherein said second ground surface slopes from a level approximately at the level of the first ground surface to a level below the level of the first ground surface.

15. The above-ground swimming pool defined in claim 2 wherein said second ground surface is level with said first ground surface.

16. An above-ground swimming pool comprising:

a first wall extending above a first ground surface and having a first wall height, said first wall having opposite ends;

a pair of transition elements, each transition element being mounted to a respective end of said first wall;

a second wall extending above said first ground surface and having a second wall height smaller than said first wall height, said second wall having opposite ends each attached to a respective one of said transition elements, said first wall and said second wall together defining a primary pool area;

a third wall extending above a second ground surface adjacent said first surface and having a third wall height smaller than said first and second wall heights, said third wall having opposite ends each attached to one of said transition elements, said second wall and said third wall together defining a secondary pool area, said primary pool area bring larger than said secondary pool area.

17. The above-ground swimming pool defined in claim 16, further comprising a water inlet disposed in said secondary pool area, a water outlet disposed in said primary pool area, a pipeline extending between said inlet and said outlet, and a pump disposed along said pipeline to pump water from said inlet to said outlet.

18. The above-ground swimming pool defined in claim 17, further comprising a check valve disposed along said pipeline for preventing water from flowing in a direction from said primary outlet to said primary inlet.

19. The above-ground swimming pool defined in claim 18, further comprising an additional water outlet disposed in said secondary pool, said additional outlet communicating with said pipeline through a T-valve, so that water pumped by said pump can selectively be directed through said water outlet or through said additional water outlet.

20. The above-ground swimming pool defined in claim 16 wherein an end edge of said first wall and an upper edge of said second wall form a corner, further comprising a weir mounted to said first wall and said second wall in said corner.

21. The above-ground swimming pool defined in claim 16, further comprising a primary liner disposed in said primary pool area, said primary liner extending generally horizontally over the first ground surface and generally vertically along said first and second walls, and a secondary liner disposed in said secondary pool area, said secondary liner extending generally horizontally over the second ground surface and generally vertically along said second and third walls, wherein said primary liner and said secondary liner are attached to one another to form an integral liner, said integral liner extending over an upper edge of said second wall.

22. The above-ground swimming pool defined in claim 16, further comprising a tension cord extending across said second wall below said upper edge of said second wall.

23. The above-ground swimming pool defined in claim 16 wherein said third wall is supported above said second ground surface by a plurality of spacers disposed along said third wall.

24. The above-ground swimming pool defined in claim 16, further comprising an elongate illumination element mounted along an upper edge of said second wall.

25. An above-ground swimming pool comprising:

a primary wall extending above a first ground surface enclosing a primary pool area, said primary wall including an enclosure region having a first wall height and a spillway region having a second wall height lower than said first wall height;

an enclosure defining a secondary pool area, said secondary pool area being adjacent to said primary pool area and extending at least along said spillway region of said primary wall, said primary wall having an upper edge at said spillway region;

a primary liner disposed in said primary pool area, said primary liner extending generally horizontally over the first ground surface and generally vertically along said primary wall at said enclosure region and said spillway region, said primary liner having a first bead attached thereon extending approximately across said upper edge of said spillway region;

a secondary liner disposed in said secondary pool area, said secondary liner extending generally vertically along said primary wall at said spillway region, said secondary liner having a second bead attached thereon extending approximately across said upper edge of said spillway region; and a receptor band having a substantially inverted-U-shaped cross-section for receiving said upper edge of said spillway region, said receptor band being disposed on said upper edge, said receptor band further including a first cusp mounted thereon for receiving said first bead and a second cusp mounted thereon for receiving said second bead.

26. The above-ground swimming pool defined in claim 25 wherein said primary liner further includes a liner flap mounted thereon, said flap extending over said upper edge of said spillway region.

27. The above-ground swimming pool defined in claim 25, further comprising:

a third cusp mounted along said receptor band; and a liner flap having a bead therealong, said bead being mounted in said third cusp, said liner flap extending over said upper edge of said spillway.

* * * * *